US006113181A

United States Patent [19]

Tang

[11] Patent Number: 6,113,181

[45] Date of Patent: Sep. 5, 2000

[54] FOLDABLE AND CARRYABLE LOUNGING-BEACH CHAIR

[76] Inventor: Larry Tang, 45 Park Knoll Dr., East Brunswick, N.J. 08816

[21] Appl. No.: 09/377,535

[22] Filed: Aug. 19, 1999

[51] Int. Cl.[7] ..... A47C 4/00

[52] U.S. Cl. ..... 297/27; 297/188.04; 297/354.13

[58] Field of Search ..... 297/27, 188.07, 297/188.04, 377, 354.13, 284.1, 284.11, 423.2, 423.21, 452.18, 452.2, 440.24, 440.1, 28, 423.19

[56] References Cited

U.S. PATENT DOCUMENTS 2,216,317 10/1940 Karish .
2,652,882 9/1953 Kotler .
4,514,009 4/1985 Vanderminden et al. .
4,955,517 9/1990 Maresca .
5,588,708 12/1996 Rykken et al. .

FOREIGN PATENT DOCUMENTS 800907 9/1958 United Kingdom .

*Primary Examiner*—Milton Nelson, Jr.
*Attorney, Agent, or Firm*—Charle I. Brodsky

[57] ABSTRACT

A beach chair having a back rest arranged to rotate 90° forwardly and rearwardly from the vertical in a construction having a front section arranged to telescope outwardly from a seat rest when intended for use as a lounge and to collapse inwardly of the seat when intended for use as a straight-back chair, with arm rests coupled with the back rest and with the seat rest to secure both the seat rest and the front section on the ground whether the front section is collapsed inwardly as the chair or telescoped outwardly as the lounge.

18 Claims, 3 Drawing Sheets

FOLDABLE AND CARRYABLE LOUNGING-BEACH CHAIR

FIELD OF THE INVENTION

This invention relates to folding chairs, in general, and to a foldable, carryable beach chair, in particular.

BACKGROUND OF THE INVENTION

As is well known and understood, garden-type chairs conventionally are of a two types—a lounge and a straight-back chair. In usual construction, they most often are heavy and sturdy, and usually remain outdoors no matter what the weather conditions might be.

Lawn chairs, on the other hand, are much lighter in weight, are not as stable in use, and are typically folded and carried indoors when the weather threatens. Because of their light-weight, they are easily transported and taken from place to place (as to an outdoor concert or to a picnic). Relatively inexpensive—and far less costly than those found in the garden or on a patio—, these lawn chairs also come in lounge and straight-back varieties.

Beach chairs, on the other hand, are generally the least expensive of all—and as their name implies, are carried to a lake or seashore area, and frequently placed in the water for a user to sit on in trying to keep cool. However, those beach chairs that are available are by-and-large only straight-back in design. No lounge type beach chair is generally available.

SUMMARY OF THE INVENTION

As will become clear hereinafter, the present invention concerns a foldable and carryable lounging-beach chair, which in one arrangement, can be used as a straight-back chair, while in a second arrangement, can be used as a lounge. Only one beach chair need thus be purchased to provide the desirable characteristics of each type, and only one needs to be transported to serve both functions. By fabricating this combined lounging-beach chair of tubular construction, the cost of it at retail can be kept reasonably low.

Thus, as will be seen, the foldable and carryable lounge-beach chair of the invention includes a back rest having an upper section and a pair of downwardly extending side sections, along with a seat rest having a rear section which is hingeably coupled to the side sections of the back rest adjacent to its lower end. As will be described, the seat rest also includes a front section arranged to telescope outwardly from the rear section for use, and to collapse inwardly of the rear section when the beach chair is to be converted from use as a lounge to use as a straight-back chair. An arm rest is provided according to the invention, as pair of arms, each of which is removably connected at a first point on the side sections of the back rest, and between its lower end and its upper section. At the same time, as will be set forth below, each of the arms is removably connected at a second point to a point in the front section of the seat rest. With the arm rest having a forward section which extends to the ground when in use, and with the front section of the seat rest also extending to the ground when telescoped outwardly or collapsed inwardly with respect to the rear section of the seat rest, a combination chair is provided, in which the lounge portion can telescope outwardly from the seat portion when lounging is desired, or can be collapsed inwardly of the seat portion when an upright sitting is preferred.

As will be further understood, the length the lounge portion extends is controllable as well. Similarly, the back rest can be controlled to a desired angle—and is further provided with a rotatable stand to rest on the ground when freed from a pair of restraining clamps, or folded flat for carrying the combined chair about. With a first cover providing the seat, and with a second cover providing the back, a third cover can be included (either kept in a separate storage bag joined to the back rest, or as an inclusion in a described seat fabrication) to cover the front section when a lounge use is desired. Constructed of steel or aluminum tubing, the foldable and carryable lounging-beach chair in a preferred embodiment incorporates a series of depressible locking pins to seat within provided apertures in fixing the lounging chair in its intended position.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
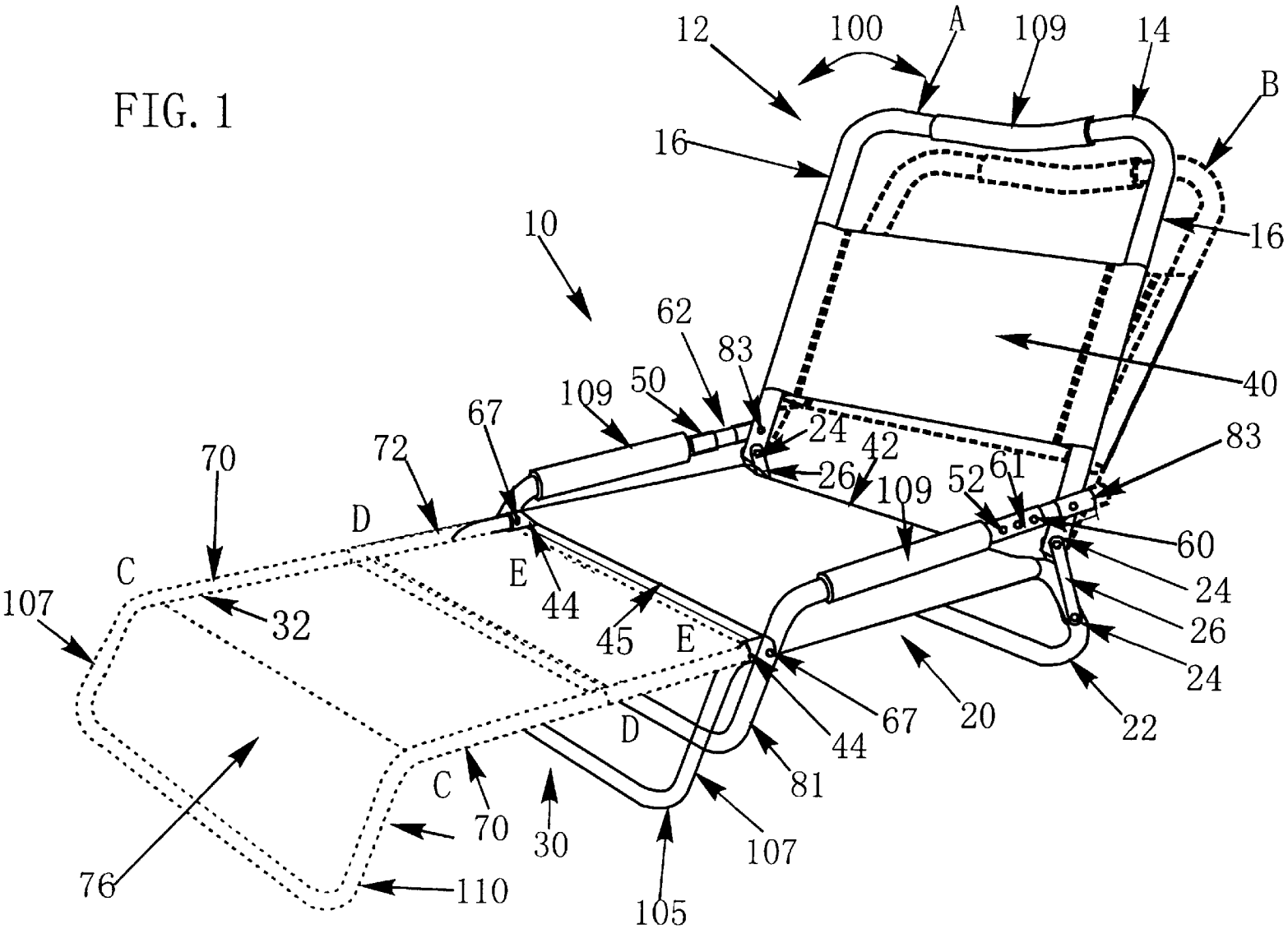
FIG. 1 is a front perspective view of a foldable and carryable lounging-beach chair constructed in accordance with the invention.
Figure 2:
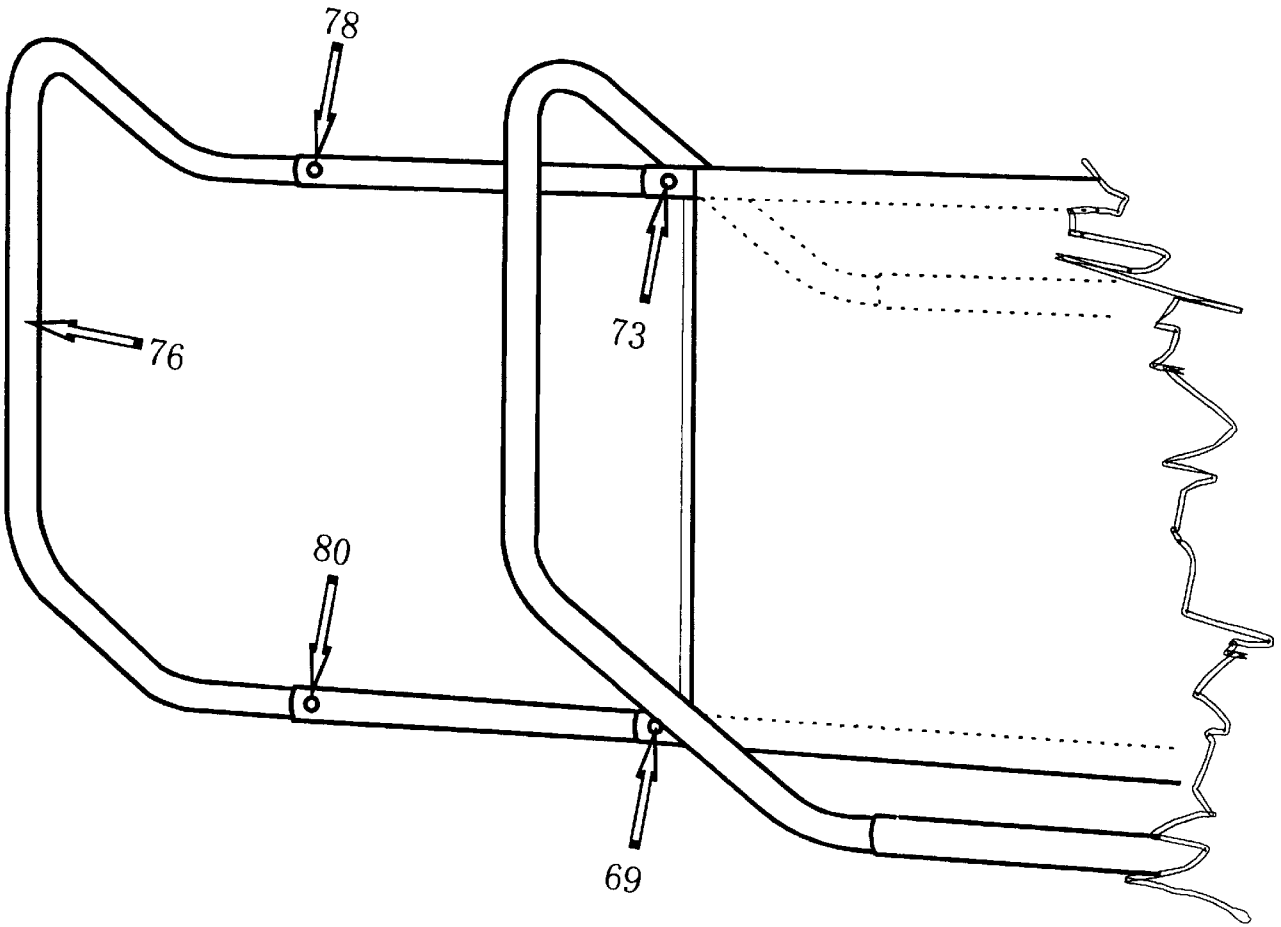
FIG. 2 is a rear perspective view of the chair.
Figure 3:
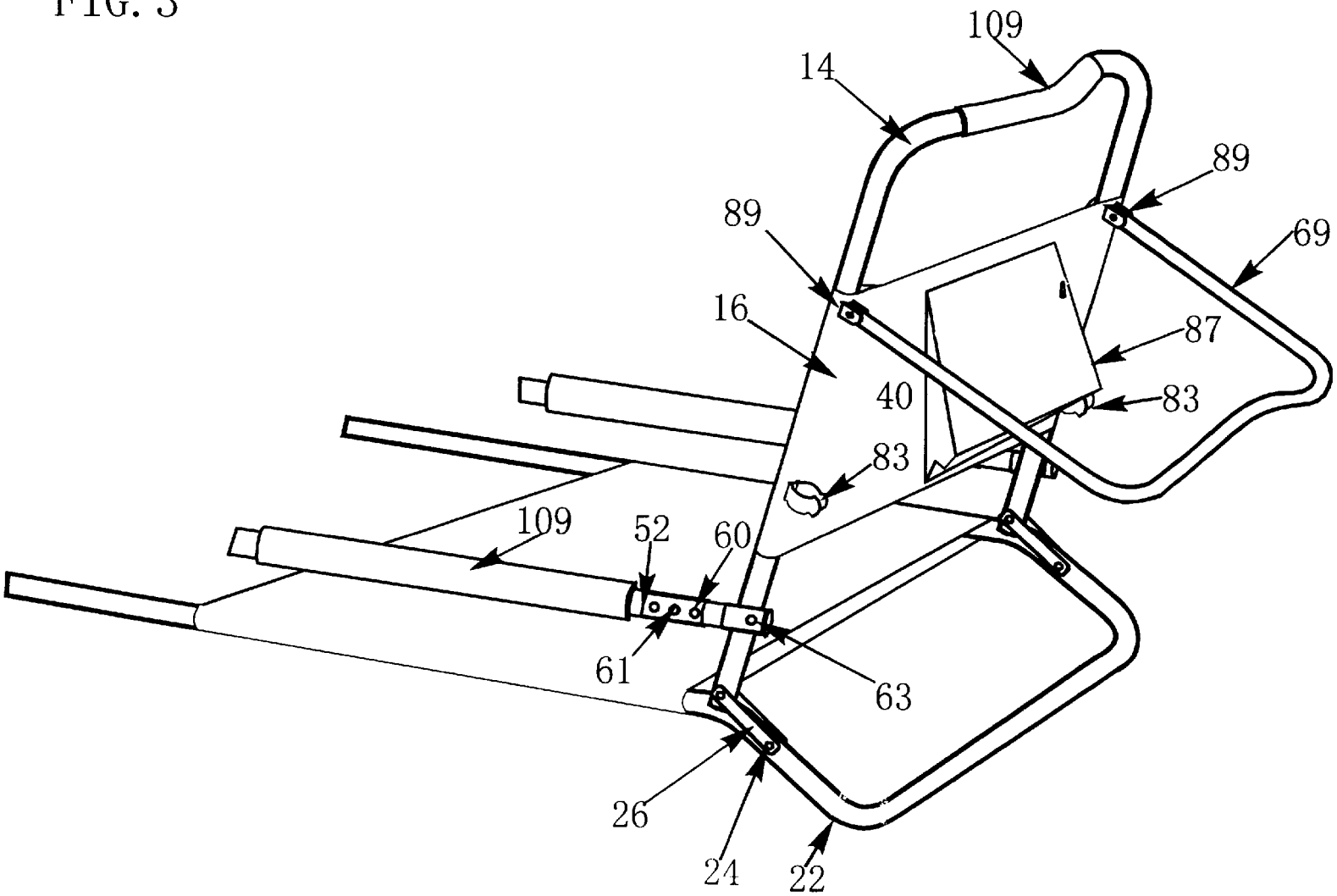
FIG. 3 is a view helpful in an understanding as to the locking of the lounge section of the beach chair in position.

In FIGS. 1–3, the beach chair 10 includes a back rest 12 having an upper section 14 and a pair of downwardly extending side sections 16. Position A identifies the beach chair with the back rest 12 generally upright, while position B represents the beach chair with the back rest 12 tilted rearwardly.

The lounging-beach chair 10 also includes a seat rest 20 having a rear section 22 which is hingeably coupled to the side sections 16 of the seat rest 12, as by means of a pair of rivets 24 and a connecting arm 26. Such coupling allows the tilting from position A to position B—and further, as desired, the extent of permitting the back rest 12 to rotate substantially 90° from the vertical, forwardly or rearwardly, as illustrated by the arrow 100.

The seat rest 20 also includes a front section 30 which is arranged to telescope outwardly from the rear section 22 or to collapse inwardly of it. To accomplish this, the front section 30 may include tubular arms 32 either to fit over, or within corresponding tubular extensions formed in the rear section 22. As indicated at positions C, D and E, the front section 30 can telescope outwardly from the rear seat section 22, the lengths shown as 70 and 72, or to any length desired in between. The position shown at 105 will be understood to be that with the front section 30 fully collapsed into the rear seat section 22, while the position shown at 110 is for the front section 30 being fully extended. As indicated by the notation 107, the front section 30 is of a height to rest on the ground, level with the rear section 22. As FIG. 2 indicates, the forward-most section 76 of the front section 30 is provided with a depressible pin 78 arranged to fit within an aperture 80 in the underside of the seat section 20 to lock the front section 30 into position in accordance with the extending length desired for the lounge. A similar depressible pin 73 locks the rear-most section 83 in a further aperture 69 in the underside of the seat section 20.

As shown in FIG. 1, the back rest 12 is provided with a cover 40, while the seat rest 20 is provided with a second cover 42. With the cover 42 encircling the side edges 44 of the seat area 20, a spacing 45 can be provided in which a third cover may be kept (as on a "shelf") to be removed for placement over the front area 30 once the front section 30 is telescoped outwardly, as shown. In the instance where the lounge feature is not desired, i.e. where the front section 30 is collapsed back inwardly to the rear seat, then this third cover can be retained in the shelf so formed.

The foldable and carryable lounging-beach chair also includes an arm rest having a pair of arms 50, 52, each of which is removably connected with the side sections 16 of the back rest 12. In particular, the arm rest 52 is shown with apertures 60 to receive a depressible pin 61 which extends from an arm 62 which is, in turn, rotatably secured to the side sections 16, as by means of a pin 63. Depending upon which aperture 60 the pin 61 is fitted into and locked, the angle of the back rest 12 can be adjusted, as in the direction of the arrow 100. Such arm rest further is fixedly secured as at 67 to the seat rest area 44, and is itself of a height 81 to rest on the ground whether or not the front section 30 is telescoped outwardly or collapsed inwardly. In this preferred embodiment of the invention, all sections are of tubular construction (which may be fabricated either of steel or of aluminum), except for the back, seat and lounge covers which may be of a polyester composition.

FIG. 3 illustrates a storage bag 87 at the rear of the back rest cover 40, along with a rotatable stand 69. Such stand is secured with the back rest 12 as at 89, and a pair of restraining clamps 83 are included so that the stand 69 can be rotated to be secured with the clamps 83, or released so as to further rest upon the ground in permitting the lounge to lie flat.

In use, when the lounging-beach chair is intended to be employed as a beach chair only, the rotatable stand 69 is closed and secured in the clamps 83 to be held in place. The back rest 12 is then oriented along the direction of the arrow 100 to the position desired, and the front section 30 is collapsed inwardly. To then be transported about, the back rest 12 is further rotated to lie atop the seat cover 42. The hinged coupling at 22, 24 and the pin connection at 60 operate to further rotate the lounging-beach chair flat. When it is desired to use the chair as a lounge, the back rest 12 is then rotated upwardly towards the position shown in FIG. 1, and the front section 30 pulled outwardly the distance desired. For comfort, each of the upper sections 14 of the back rest 12, and each of the arms 50, 52 of the arm rest can be padded along their lengths, as at 109, or any one of all of them.

While there has been described what is considered to be a preferred embodiment of the present invention, it will be readily appreciated by those skilled in the art that modifications can be made without departing from the scope of the teachings herein. For at least such reason, therefore, resort should be had to the claims appended hereto for a true understanding of the scope of the invention.

I claim:

1. A foldable and carryable lounging beach chair comprising:

a back rest having an upper section and a pair of downwardly extending side sections;

a seat rest having a rear section hingeably coupled to said side sections of said back rest adjacent a lower end thereof, with said seat rest also having a front section arranged to telescope outwardly from said rear section and to collapse inwardly of said rear section;

and an arm rest having a pair of arms, each of which is removably connected at a first end to a point on said side section of said back rest between said lower end and said upper section of said back rest, and each of which is removably connected at a second point to a point in said front section of said seat rest;

with said arm rest having a forward section which extends to the ground when in use;

and with said front section of said seat rest also extending to the ground when telescoped outwardly or collapsed inwardly with respect to said rear section of said seat rest.

2. The lounging beach chair of claim 1, also including means on each of said pair of arm rest arms to vary the point of removable connection between said point on said side section of said back rest with said arms.

3. The lounging beach chair of claim 1, also including means on each of said pair of arm rest arms to vary the point of removable connection between said point of said front section of seat rest with said arm.

4. The lounging beach chair of claim 2, additionally including means on each of said pair of arm rest arms to vary the point of removable connection between said point of said front section of seat rest with said arm.

5. The lounging beach chair of claim 4, wherein said seat rest includes a first cover extending forwardly of said rear section, and between side edges thereof.

6. The lounging beach chair of claim 5, also including a second cover for said front section of said seat rest when telescoped outwardly from said rear section.

7. The lounging beach chair of claim 5, wherein said first cover encircles said side edges of said rear section.

8. The lounging beach chair of claim 7, in which the encircling of said first cover about said side edges of said rear section forms upper and lower surfaces of said first cover between which said second cover is stored when said front section of said seat rest is collapsed inwardly with respect to said rear section of said seat rest.

9. The lounging beach chair of claim 8, also including a third cover extending between said side sections of said back rest.

10. The lounging beach chair of claim 9, wherein said first, second and third covers are fabricated from a polyester composition.

11. The lounging beach chair of claim 4, also including a rotatable stand secured to said side sections of said back rest at locations remote from said seat rest.

12. The lounging beach chair of claim 11, further including first and second clamps secured to said back rest at locations remote from said seat rest for restraining said stand when rotated to a closed position.

13. The lounging beach chair of claim 4, wherein said back rest, said seat rest and said arm rest are of tubular construction.

14. The lounging beach chair of claim 12, wherein said back rest, said seat rest and said arm rest are constructed of steel tubing.

15. The lounging beach chair of claim 12, wherein said back rest, said seat rest and said arm rest are constructed of aluminum tubing.

16. The lounging beach chair of claim 4, additionally including a storage bag secured rearwardly of said back rest.

17. The lounging beach chair of claim 4, in which said back rest is padded along at least a length of said upper section.

18. The lounging beach chair of claim 4, wherein each of said pair of arms are padded along a length thereof.

* * * * *